United States Patent [19]

Toutant et al.

[11] Patent Number: 4,828,887

[45] Date of Patent: May 9, 1989

[54] METHOD AND APPARATUS FOR APPLYING MATERIAL TO SELECTED AREAS OF A MOVING PART

[75] Inventors: Roy T. Toutant; Richard M. Motley; David S. Perry, all of Louisville, Ky.

[73] Assignee: General Electric Company, Louisville, Ky.

[21] Appl. No.: 123,793

[22] Filed: Nov. 23, 1987

[51] Int. Cl.[4] ..... B05D 1/02

[52] U.S. Cl. ..... 427/424; 118/302; 118/314; 118/315; 118/669; 118/679; 118/684

[58] Field of Search ..... 427/424; 118/302, 314, 118/315, 669, 679, 684

[56] References Cited

U.S. PATENT DOCUMENTS

| | | | |
|---|---|---|---|
| 2,608,949 | 9/1952 | Pasotti | 118/315 |
| 3,030,915 | 4/1962 | Shannon | 118/669 |
| 3,444,839 | 5/1969 | Ellul | 118/314 |
| 3,584,571 | 6/1971 | Schmoll | 118/315 |
| 4,380,967 | 4/1983 | Matt | 118/669 |
| 4,527,510 | 7/1985 | Arndt | 118/669 |
| 4,542,044 | 9/1985 | Gano | 118/684 |
| 4,687,137 | 8/1987 | Boger | 118/315 |

*Primary Examiner*—Shrive Beck
*Assistant Examiner*—Vi D. Dang
*Attorney, Agent, or Firm*—Frederick P. Weidner; Radford M. Reams

[57] ABSTRACT

A moving part has material initially applied to it a predetermined distance from its leading edge. Whenever a sensor senses a notch in a flange of the moving part, application of material to the moving part is stopped for a predetermined distance prior to the start of the notch to a predetermined distance beyond the notch. Application of material to the moving part is finally stopped a predetermined distance prior to its trailing edge. Two separate sensors are used to control each of three spray guns for applying the material in the selected areas.

20 Claims, 6 Drawing Sheets

METHOD AND APPARATUS FOR APPLYING MATERIAL TO SELECTED AREAS OF A MOVING PART

FIELD OF THE INVENTION

This invention relates to a method and apparatus for applying material to selected areas of a moving part and, more particularly, to a method and apparatus for controlling the application of material to selected areas of a moving part.

BACKGROUND OF THE INVENTION

A refrigerator cabinet has its outer case fabricated from a sheet of metal. Prior to folding a sheet of metal, it is necessary to apply a liquid mold release chemical to selected areas of the outer case.

The liquid mold release chemical is utilized as a lubricant to enable a plastic liner, which is mounted in a groove formed in the outer case adjacent its front flange that is formed by one of the side flanges of the sheet of metal, to have movement relative to the outer case during spraying of foam insulation. This is because the outer case expands when foam insulation is sprayed at a relatively high temperature in a liquid state and the outer case contracts during curing of the foam insulation to its solid state. This contraction and expansion of the outer case could possibly cause the plastic liner to crack if it could not move relative to the outer case. Accordingly, the use of the liquid mold release chemical prevents this potential damage to the plastic liner.

It also is necessary to prevent the application of this material to areas where the sheet of metal is folded and at the leading and trailing edges of the sheet of metal. The sheet of metal has notches formed in each of its side flanges at each of the locations at which the sheet of metal is to be folded to form the outer case. Thus, each of the fold areas is identified by the presence of the notch.

It is desired to prevent any of the liquid mold release chemical from entering the groove in one of the side flanges of the sheet of metal at each of the notches. This is because a corner bracket is installed at each of the notches where folding of the sheet of metal occurs to form the outer case, and the liquid mold release chemical would be picked up by the equipment to cause the equipment to eventually become dirty whereby it might cease to function.

U.S. Pat. No. 4,389,971 to Schmidt discloses the application of glue to a single area beginning a predetermined distance from the leading edge of a paper board box blank and stopping a predetermined distance from the trailing edge of the box blank. Since the aforesaid Schmidt patent seeks to have all the area therebetween covered with glue, there is no recognition of any interruption of this single defined glue area.

U.S. Pat. No. 3,245,376 to Romstadt activates spray guns when a leading edge of a glass sheet interrupts a light beam and deactivates them when a trailing edge moves past the beam. The aforesaid Romstadt patent also has additional spray guns to provide thickened portions in the corners of the glass sheet.

U.S. Pat. No. 3,607,340 to Stroupe applies a spot coating or a continuous coating to a sheet of material. The aforesaid Stroupe patent has sensing means, which is responsive to the presence of a sheet or indicia thereon, for generating a signal to a delay device that controls the length of time the coating is applied. There is no recognition in the aforesaid Stroupe patent of starting and stopping the application of material to a moving part in accordance with when portions of the moving part arrive at certain positions relative to the material application means.

U.S. Pat. No. 3,646,521 to Porter sprays objects of diverse geometry. While a lead-lag control circuit is utilized in the aforesaid Porter patent to not coat a portion of an object, there is no recognition of sensing the presence of certain portions of the object for utilization in determining when there is to be no spraying of material on the object.

The method and apparatus of the present invention is capable of controlling when the material is applied to a sheet of metal so that the material will not be applied in the areas to be folded or the areas adjacent the leading and trailing edges of the sheet of metal. There also is no requirement that the specific areas to which the material is not to be applied has to be the same. Of course, as long as a single size refrigerator cabinet is being produced, it will be.

Furthermore, because the sheet of metal is moving at a rather rapid feed rate such as 350 feet per minute, the omission of the application of material to only four inches, for example, on each side of the notch in which the fold occurs is an area that relatively quickly passes the material applying means. Accordingly, the method and apparatus of the present invention must be capable of responding quickly and accurately to sensing signals which sense the presence of the notch in specific locations during its travel relative to the material applying means.

SUMMARY OF THE INVENTION

The method and apparatus of the present invention determines when the leading edge of the sheet of metal has passed the material applying means so that material can be applied to the sheet of metal. The method and apparatus of the present invention also determines when to stop the application of material to an area of the moving sheet of metal and when material is again to be applied. The method and apparatus of the present invention also determines when to stop the application of material as the trailing edge of the sheet of metal approaches the material applying means.

An object of this invention is to provide a method and apparatus for applying material to selected areas of a moving part.

Another object of this invention is to provide a method and apparatus for spraying a desired pattern on a moving part.

A further object of this invention is to provide a method and apparatus to spray material on an outer case of a refrigerator cabinet in its unfolded configuration only to areas that are not be folded and are not at the leading and trailing edges.

Other objects of this invention will be readily perceived from the following description, claims, and drawings.

BRIEF DESCRIPTION OF THE DRAWINGS

The attached drawings illustrate a preferred embodiment of the invention, in which.

Figure 1:
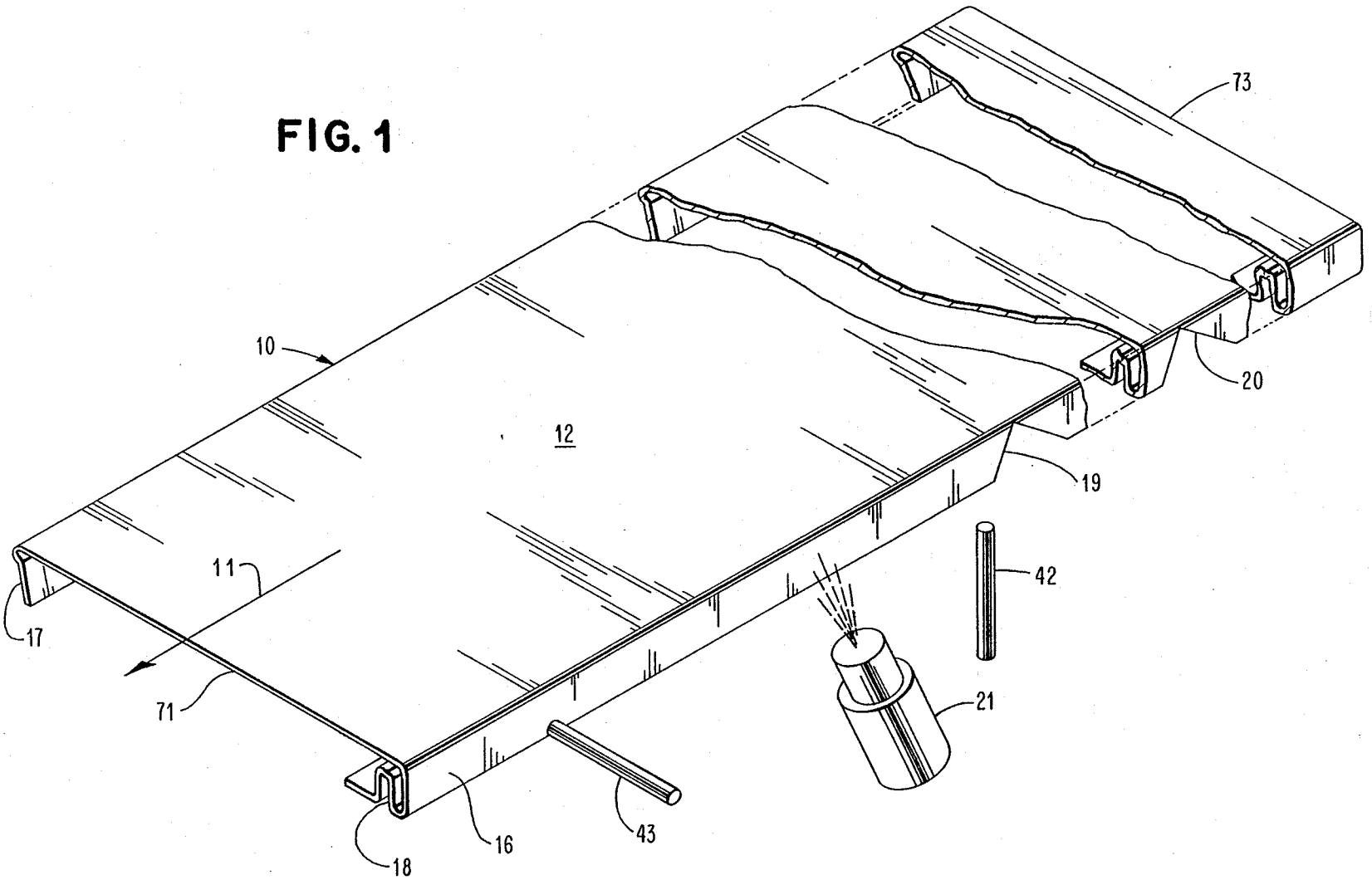
FIG. 1 is a schematic perspective view, partly in section, showing a portion of a moving sheet of metal having material sprayed thereon by spray guns and showing a portion of the apparatus of the present invention.

Referring to the drawings and particularly FIG. 1, there is shown a sheet 10 of metal, which is moving in the direction of an arrow 11. The sheet 10 of metal includes a flat central portion 12 resting on guide rollers such as a roller 13 (see FIG. 2) of a conveyor, which includes other guide rollers such as rollers 14 and 15, for example, for guiding the sheet 10 of metal in the direction of the arrow 11 (see FIG. 1).

The sheet 10 of metal includes a pair of flanges 16 and 17 extending from the opposite sides of the central portion 12. The flange 16 has a groove 18 formed therein to receive a portion of a plastic liner (not shown) after the sheet 10 of metal has been bent to form an outer case of a refrigerator cabinet.

To enable bending of the sheet 10 of metal at the desired locations to form the outer case of the refrigerator cabinet, the flange 16 has notches 19 and 20 formed therein at selected longitudinally spaced locations. The flange 17 has similar notches (not shown) and oppositely disposed to the notches 19 and 20.

Figure 4:
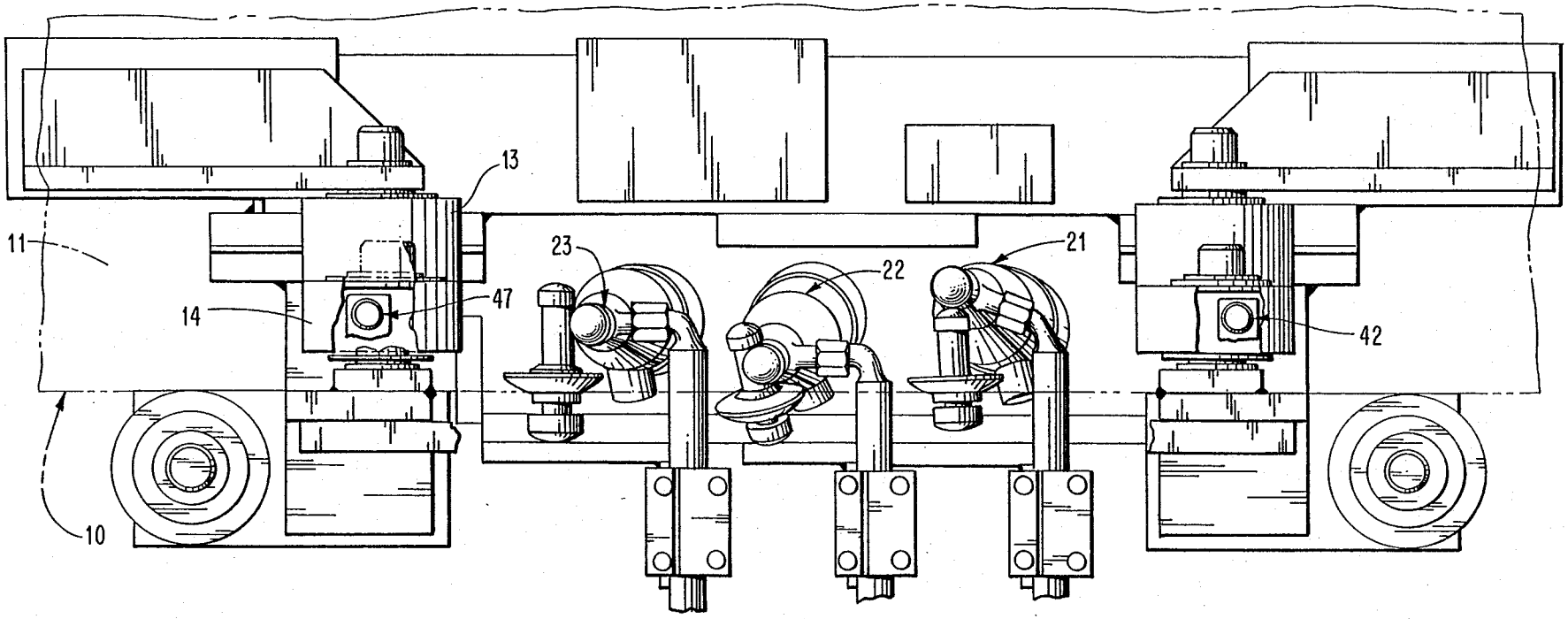
FIG. 4 is a fragmentary top plan view of a portion of FIG. 3.

A plurality of spray guns 21 (see FIG. 4), 22, and 23 is positioned beneath the sheet 10 of metal for applying the liquid mold release chemical to the selected areas of the sheet 10 of metal. One suitable example of the liquid mold release chemical is a liquid water and wax emulsion sold by Brulin & Co., Inc., Indianapolis, In. as composition No. 2055.

The material is contained within a tank 24 (see FIG. 6) from which it is pumped by a pump 25, which has an air driven motor, through a pressure regulator 26 and a line 27 to each of the spray guns 21, 22, and 23. One suitable example of the spray guns 21–23 is sold by Paasche Airbrush Co., Harwood Heights, Ill. as model A-AUDR-1. The pressure regulator 26 controls the pressure of the material between 5 and 10 p.s.i.

The spray guns 21, 22, and 23 can only supply material through each of nozzles 28, 29, and 30, respectively, when air pressure is supplied to each of the spray guns 21–23 from a compressor 31. The output of the compressor 31 is supplied through a dust filter 32 and a coalescing filter 33 to remove moisture. A pressure regulator 34 controls the air pressure so that it is supplied at 60 p.s.i. to the spray guns 21–23.

A normally closed solenoid valve 35 blocks the output of the compressor 31 to the spray guns 21–23. The solenoid valve 35 is energized under control of a programmable controller so that it is open when it is desired to supply pressurized air to the spray guns 21–23. The solenoid valve 35 is deenergized from the programmable controller if the sheet 10 (see FIG. 1) of metal cannot be advanced from the guide rollers 13 (see FIG. 3)–15 of the conveyor or there is a power loss in the system.

The solenoid valve 35 (see FIG. 6) allows communication from the compressor 31 to the spray gun 21 under control of a normally open solenoid valve 36. A normally open solenoid valve 37 is interposed between the solenoid valve 35 and the spray gun 22, and a normally open solenoid valve 38 is disposed between the solenoid valve 35 and the spray gun 23.

Figure 5:
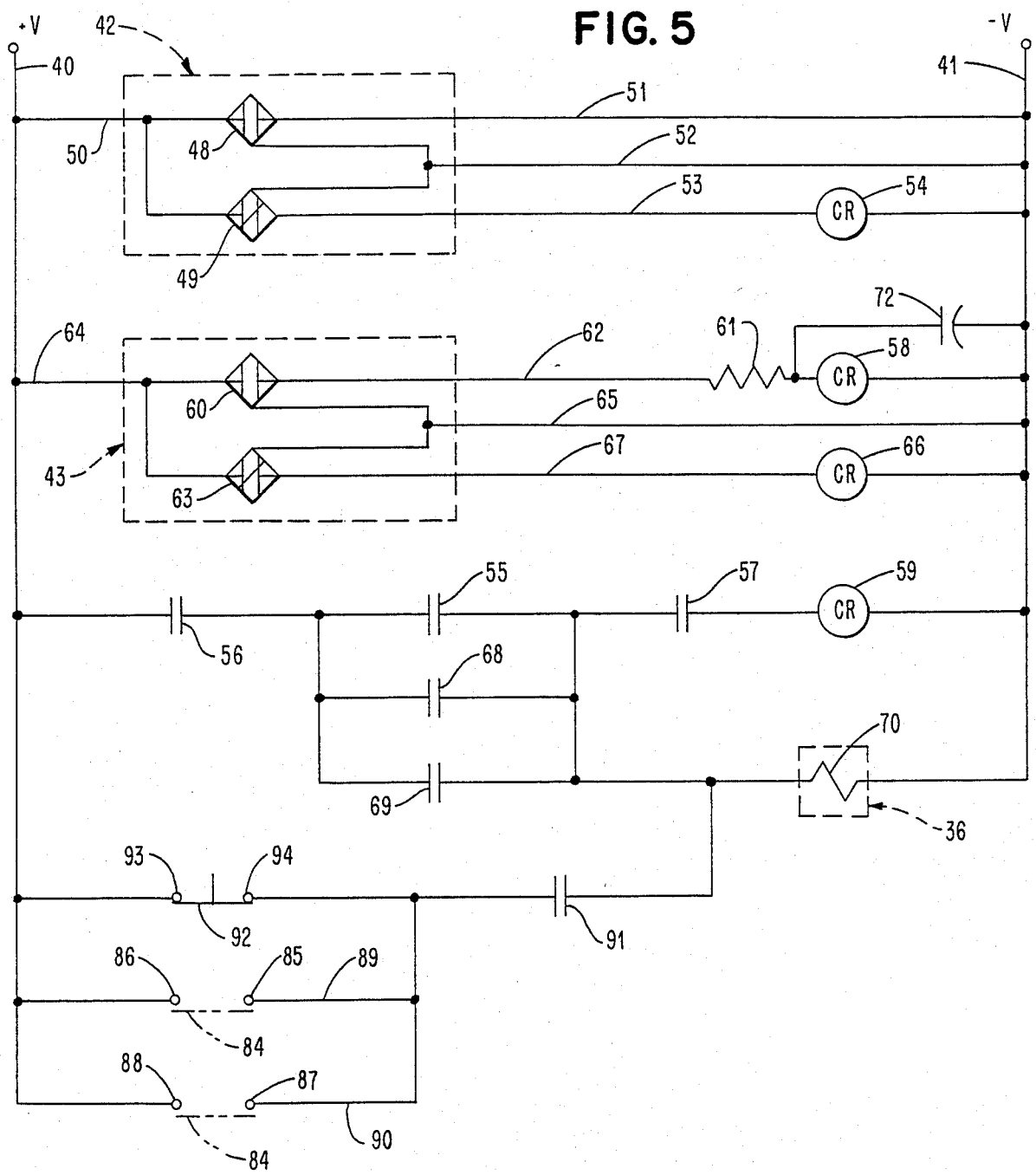
FIG. 5 is a schematic electrical diagram for controlling one of the spray guns for spraying material onto the moving sheet of metal.

Each of the solenoid valves 36–38 is controlled by a separate electrical control circuit. The electrical circuit for controlling the solenoid valve 36 is shown in FIG. 5. The electrical circuit has a positive DC voltage, +V, applied to a conductor 40 and a negative DC voltage, −V, connected to a conductor 41. Proximity switches 42 and 43, which function as sensors, are connected between the conductors 40 and 41.

Figure 3:
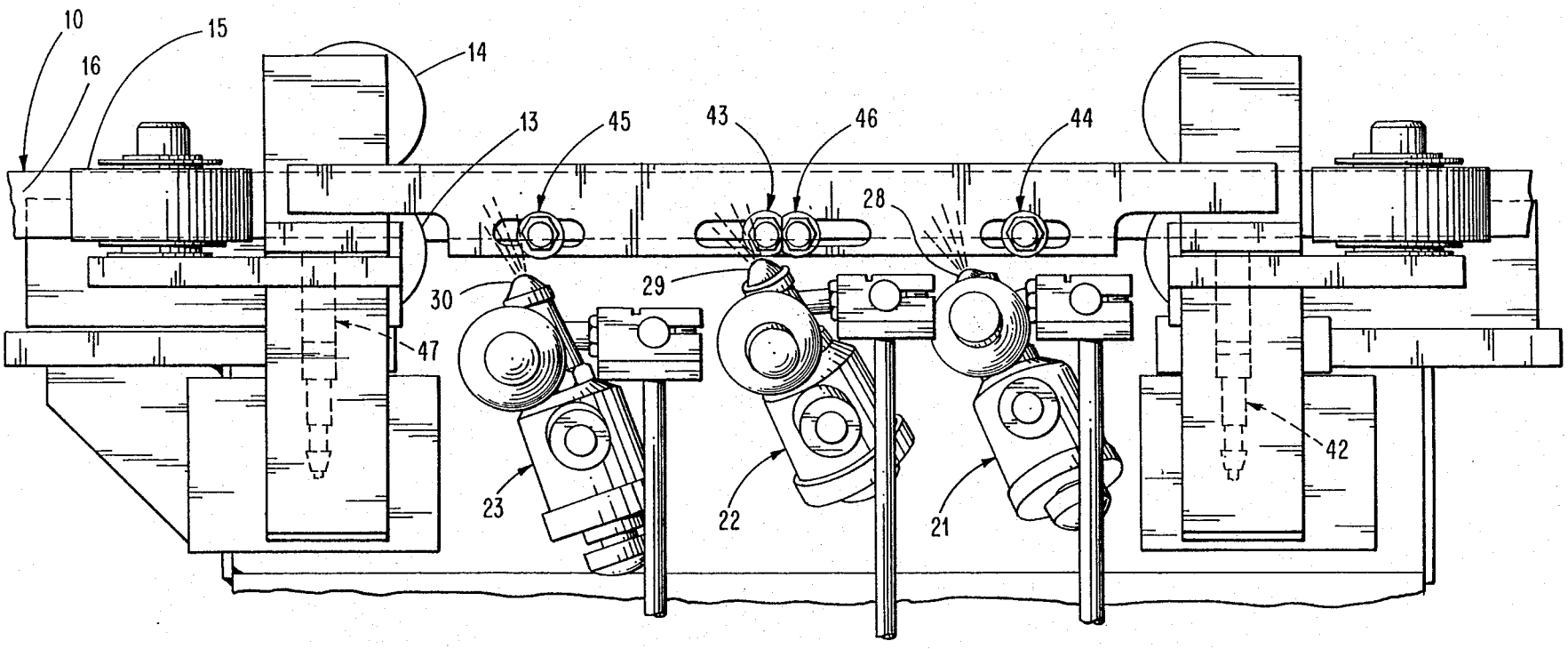
FIG. 3 is a fragmentary side elevational view showing the locations of each of the spray guns relative to the sheet of metal and sensors for controlling each of the spray guns.

As shown in FIG. 3, the proximity switch 42 is disposed upstream of the spray gun 21 a predetermined distance, and the proximity switch 43 is disposed downstream of the spray gun 21 a predetermined distance. These predetermined distances can be the same or different.

The spray gun 22 has a proximity switch 44 disposed upstream and a proximity switch 45 disposed downstream. The proximity switch 44 is disposed substantially the same distance from the nozzle 29 of the spray gun 22 as the proximity switch 42 as positioned from the nozzle 28 of the spray gun 21. The proximity switch 45 is located substantially the same distance from the nozzle 29 of the spray gun 22 as the proximity switch 43 is disposed from the nozzle 28 of the spray gun 21.

The spray gun 23 has a proximity switch 46 disposed upstream and a proximity switch 47 disposed downstream. The proximity switch 46 is disposed substantially the same distance from the nozzle 30 of the spray gun 23 as the proximity switch 42 is positioned from the nozzle 28 of the spray gun 21. The proximity switch 47 is located substantially the same distance from the nozzle 30 of the spray gun 23 as the proximity switch 43 is disposed from the nozzle 28 of the spray gun 21.

One suitable example of each of the proximity switches 42–47 is a proximity switch sold by General Electric as model CR215-DB18SC3PA. This proximity switch works on an electromagnetic field and has no physical electrical contacts.

As shown in FIG. 5, the proximity switch 42 includes a normally open function 48 and a normally closed function 49 acting in the same manner as physical electrical contacts. The normally open function 48 and the normally closed function 49 are connected to the positive conductor 40 through a conductor 50. The normally open function 48 is connected to the negative conductor 41 through conductors 51 and 52. The conductor 52 also connects the normally closed function 49 to the negative conductor 41. The normally closed function 49 also is connected through a conductor 53 and a control relay 54 to the negative conductor 41.

The control relay 54 has normally open contacts 55 connected in series with a normally open reed switch 56, normally open contacts 57 of a control relay 58, and a control relay 59 between the conductors 40 and 41. The normally open reed switch 56 is activated by the programmable controller when spraying of the sheet 10 (see FIG. 1) of metal is to occur. Thus, the reed switch 56 (see FIG. 5) must be closed for any spraying to occur.

The control relay 58 is connected to a normally open function 60 of the proximity switch 43 through a resistor 61 and a conductor 62. The normally open function 60 and a normally closed function 63 of the proximity switch 43 are connected to the positive conductor 40 by a conductor 64. The normally open function 60 and the normally closed function 63 of the proximity switch 43 are connected to the negative conductor 41 by a conductor 65. The normally closed function 63 is connected to a control relay 66 by a conductor 67.

Each of the control relays 54, 58, 59, and 66 is a solid state control relay sold by Opto 22, Huntington Beach, Calif. as Model DC 60S3.

The control relay 66 has its normally open contacts 68 in parallel with the normally open contacts 55 of the control relay 54. The normally open contacts 68 of the control relay 66 also are in parallel with normally open contacts 69 of the control relay 59. Whenever the reed switch 56 is closed and one of the normally open contacts 55, 68, and 69 is closed, a coil 70 of the solenoid valve 36 is energized to close the solenoid valve 36 to prevent spraying by the spray gun 21 (see FIG. 3) from occurring.

When the sheet 10 (see FIG. 1) of metal is advanced in the direction of the arrow 11, the sheet 10 of metal has its leading edge 71 first pass the proximity switch 42. When this occurs, the presence of the sheet 10 of metal causes the normally open function 48 (see FIG. 5) of the proximity switch 42 to close and the normally closed function 49 of the proximity switch 42 to open. The opening of the normally closed function 49 deenergizes the control relay 54 whereby the normally open contacts 55 open. However, because the leading edge 71 (see FIG. 1) of the sheet 10 of metal has not reached the proximity switch 43, the normally closed function 63 (see FIG. 5) of the proximity switch 43 remains closed so that the control relay 66 is energized. This results in the normally open contacts 68 of the control relay 66 remaining closed to maintain the coil 70 of the solenoid valve 36 energized whereby the solenoid valve 36 remains closed. Accordingly, the spray gun 21 (see FIG. 6) cannot supply material through the nozzle 28 when the solenoid valve 36 is closed.

When the leading edge 71 (see FIG. 1) of the sheet 10 of metal reaches the proximity switch 43, the normally closed function 63 (see FIG. 5) of the proximity switch 43 opens to deenergize the control relay 66 so that the normally open contacts 68 of the control relay 66 open. At the same time, the normally open function 60 of the proximity switch 43 closes to energize the control relay 58 so that the normally open contacts 57 of the control relay 58 close. However, the closing of the normally open contacts 57 of the control relay 58 does not energize the control relay 59 because the normally open contacts 55 of the control relay 54 are open. Thus, the normally open contacts 69 of the control relay 59 also are open.

As a result of all of the normally open contacts 55 of the control relay 54, the normally open contacts 68 of the control relay 66, and the normally open contacts 69 of the control relay 59 being open, the coil 70 of the solenoid valve 36 is not energized. This causes the solenoid valve 36 to return to its normally open position whereby the spray gun 21 (see FIG. 6) receives pressurized air from the compressor 31 to supply material to the sheet 10 (see FIG. 1) of metal as it passes over the spray gun 21.

When the leading edge of the notch 19, for example, reaches the proximity switch 42, the normally closed function 49 (see FIG. 5) of the proximity switch 42 again closes because of the absence of any material. This energizes the control relay 54 so that the normally open contacts 55 of the control relay 54 close. As a result, the coil 70 of the solenoid valve 36 is energized to cause closing of the solenoid valve 36 whereby the spray gun 21 (see FIG. 1) ceases to apply material to the sheet 10 of metal.

When the normally open contacts 55 (see FIG. 5) of the control relay 54 close, the control relay 59 also is energized because the normally open contacts 57 of the control relay 58 are closed due to the normally open function 60 of the proximity switch 43 being already closed because of the presence of the sheet 10 (see FIG. 1) of metal at the proximity switch 43 (see FIG. 5). Accordingly, the normally open contacts 69 of the control relay 59 close when the normally open contacts 55 of the control relay 54 close.

This provides a hold circuit for the control relay 59 even when the normally open contacts 55 of the control relay 54 again open because of the trailing edge of the notch 19 (see FIG. 1) having passed the proximity switch 42 whereby the normally closed function 49 (see FIG. 5) is open. Thus, while the notch 19 (see FIG. 1) of the sheet 10 of metal is advancing from the proximity switch 42 to the proximity switch 43, the spray gun 21 is inactivated because of the hold circuit for the control relay 59 (see FIG. 5) holding the control relay 59 activated.

When the leading edge of the notch 19 (see FIG. 1) of the sheet 10 of metal reaches the proximity switch 43, the normally closed function 63 (see FIG. 5) of the proximity switch 43 closes so that the control relay 66 is energized. This causes the normally open contacts 68 of the control relay 66 to close to maintain the coil 70 of the solenoid valve 36 energized so that the spray gun 21 (see FIG. 1) is not affected.

When the trailing edge of the notch 19 reaches the proximity switch 43, the normally open function 60 (see FIG. 5) opens so that the control relay 58 is deenergized. This causes the normally open contacts 57 of the control relay 58 to open so that the control relay 59 is dropped whereby the normally open contacts 69 of the control relay 59 open. Accordingly, the coil 70 of the solenoid valve 36 is deenergized so that the spray gun 21 (see FIG. 1) can start to spray material onto the sheet 10 of metal.

To prevent the control relay 58 (see FIG. 5) from turning on before the control relay 66 turns off whereby an undesired hold circuit would be provided through the control relay 59 to cause the coil 70 of the solenoid valve 36 to remain energized when it is to be deenergized, the control relay 58 has a capacitor 72 in parallel therewith. The capacitor 72 cooperates with the resistor 61 to form an RC circuit to delay turning on the control relay 58. This insures that the coil 70 of the solenoid valve 36 is deenergized when either the leading edge 71 (see FIG. 1) of the sheet 10 of metal or one of the notches 19 and 20 has passed the proximity switch 43. The resistor 61 (see FIG. 5) may have a resistance of 2K ohms, and the capacitor 72 may have a capacitance of 5 microfarads, for example.

The same stopping and starting of the spray gun 21 (see FIG. 1) will occur when the notch 20 passes each of the proximity switches 42 and 43. Thus, sensing of the presence of each of the notches 19 and 20 controls the stopping of the material being applied from the spray gun 21.

When the sheet 10 of metal has its trailing edge 73 pass the proximity switch 42, the normally closed function 49 (see FIG. 5) of the proximity switch 42 closes to energize the control relay 54. This closes the normally open contacts 55 of the control relay 54 to energize the coil 70 of the solenoid valve 36 to stop application of material from the spray gun 21 (see FIG. 1) to the sheet 10 of metal. At this time, the control relay 59 (see FIG. 5) is again energized so that the hold circuit is again provided through closing of the normally open contacts 69 of the control relay 59.

When the trailing edge 73 (see FIG. 1) of the sheet 10 of metal passes the proximity switch 43, the normally open function 60 (see FIG. 5) of the proximity switch 43 opens to deenergize the control relay 58 to cause the normally open contacts 57 of the control relay 58 to open. This deenergizes the control relay 59 so that the hold circuit for the control relay 59 is inactivated. As a result, the coil 70 is energized solely by the normally open contacts 55 of the control relay 54 whereby the circuit is ready for another of the sheets 10 (see FIG. 1) of metal.

Each of the spray guns 22 (see FIG. 6) and 23 has the solenoid valves 37 and 38, respectively, controlled in a similar manner by control circuits similar to that of FIG. 5. The activation and inactivation of the spray gun 22 (see FIG. 3) is controlled by the proximity switches 44 and 45, and the activation and inactivation of the spray gun 23 is controlled by the proximity switches 46 and 47.

Figure 2:
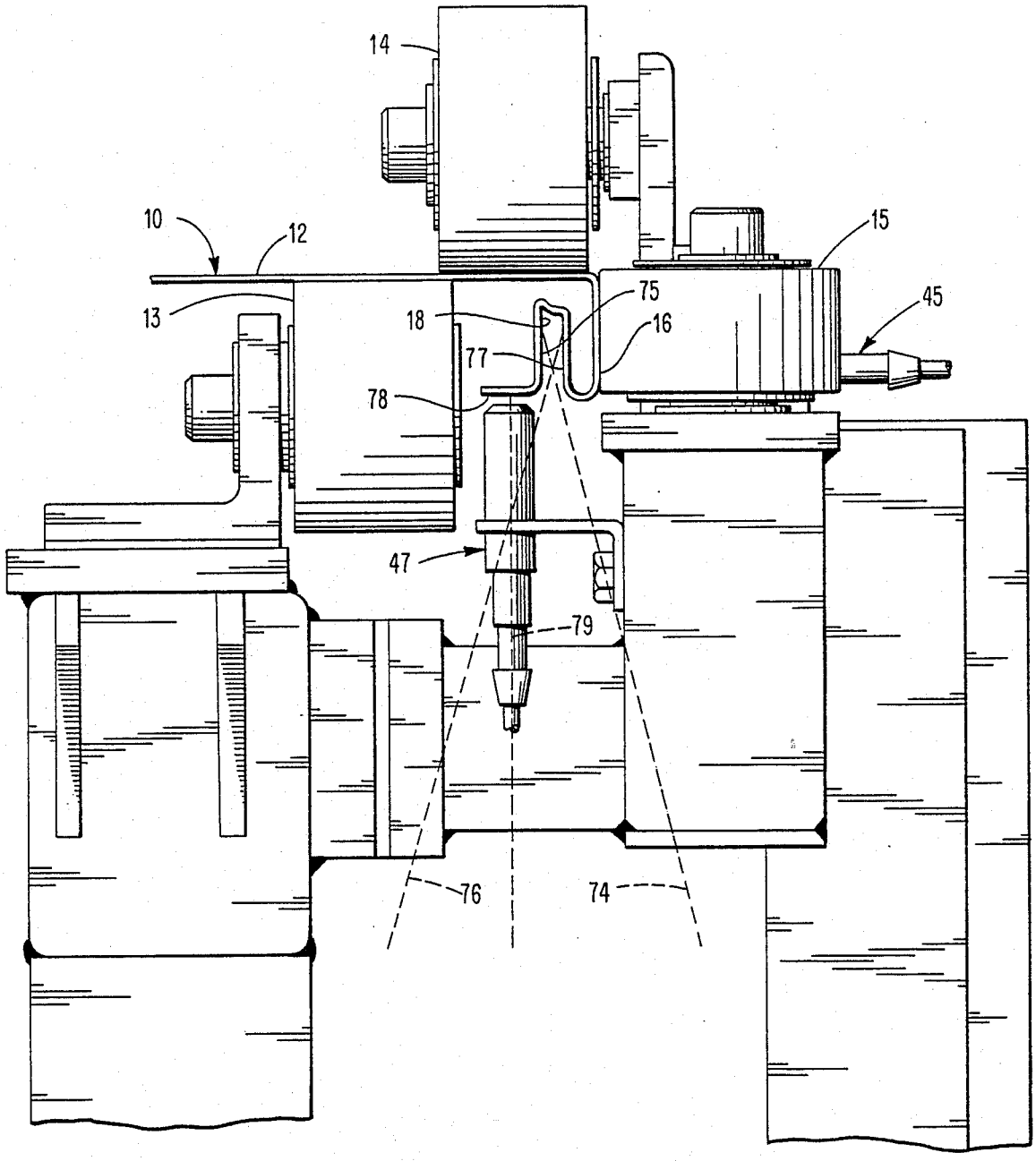
FIG. 2 is a fragmentary end elevational view of a portion of the moving sheet of metal of FIG. 1 and showing the spray paths from the spray guns for the material sprayed on the moving sheet of metal.

As shown in FIG. 2, the material from the nozzle 28 (see FIG. 6) of the spray gun 21 is applied along a path 74 (see FIG. 2) to strike a surface 75 of the groove 18 to coat it. The material from the nozzle 29 (see FIG. 6) of the spray gun 22 is supplied along a path 76 (see FIG. 2) to a surface 77 of the groove 18 to coat it. The sheet 10 of metal has its surface 78 coated with material along a path 79 from the nozzle 30 (see FIG. 6) of the spray gun 23.

Accordingly, each of the substantially parallel surfaces 75 (see FIG. 2) and 77 of the groove 18 and the adjacent surface 78 of the sheet 10 of metal has the material sprayed thereon. This provides the desired lubricating effect with a plastic liner when such is mounted within the groove 18 and against the surface 78 of the sheet 10 of metal.

After the trailing edge 73 (see FIG. 1) of the sheet 10 of metal has passed the proximity switch 47 (see FIG. 3), the same steps will be repeated with the next of the sheets 10 of metal. When production is stopped, the solenoid valve 35 (see FIG. 6) is opened, and pressurized air is released to an exhaust muffler 80. The programmable controller also causes the normally opened reed switch 56 (see FIG. 5) to return to its open position when no further spraying is to occur even though the solenoid valve 35 (see FIG. 6) has not been deenergized.

Figure 6:
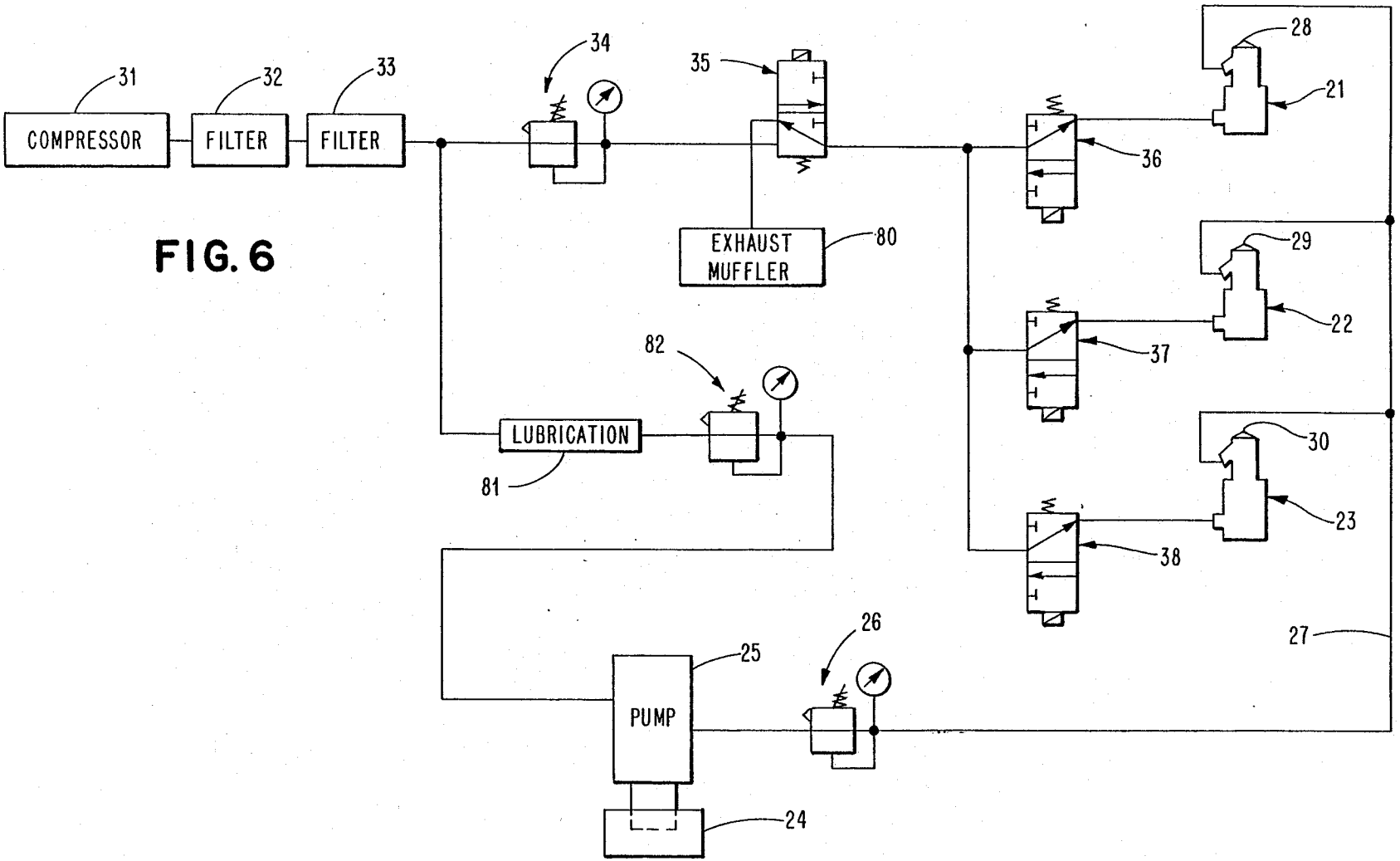
FIG. 6 is a schematic diagram of a supply of material and air for each of the spray guns and their control.

As shown in FIG. 6, the pump 25 has its air driven motor receive lubricating compressed air. The compressor 31 supplies compressed air through a lubrication member 81, which adds lubricant to the compressed air. A pressure regulator 82 maintains the pressure at 60 p.s.i.

It should be understood that a manual test control is used for set-up purposes and to determine the proper orientation of the nozzles 28, 29, and 30 of the spray guns 21, 22, and 23 respectively, with respect to the sheet 10 (see FIG. 1) of metal. This is accomplished through utilizing a four-position selector switch. One suitable example of the four-position selector switch is sold by General Electric as part No. CR104PBGO1B1R.

The four-position selector switch has a single switch portion 84 (see FIG. 5) movable between a first position in which the nozzle 28 (see FIG. 6) of the spray gun 21 is to be manually tested, a second position in which the nozzle 29 of the spray gun 22 is to be manually tested, a third position in which the nozzle 30 of the spray gun 23 is to be manually tested, and a fourth position in which none of the nozzles 28–30 is to be tested.

In the first position of the switch portion 84 (see FIG. 5) in which the nozzle 28 (see FIG. 6) of the spray gun 21 is to be tested, the switch portion 84 (see FIG. 5) is spaced from a first pair of contacts 85 and 86 and a second pair of contacts 87 and 88. The switch portion 84 is shown in phantom in an open position with respect to the contacts 85 and 86 and with respect to the contacts 87 and 88 even though there is only the single switch portion 84.

It should be understood that the contact 86 also is in the test circuit for the nozzle 30 (see FIG. 6) of the spray gun 23 and that the contact 85 (see FIG. 5) also is in the test circuit for the nozzle 30 (see FIG. 6) of the spray gun 23 through having another conductor extending therefrom in addition to a conductor 89 (see FIG. 5). Likewise, the contact 88 is in the test circuit for the nozzle 29 (see FIG. 6) of the spray gun 22, and the contact 87 (see FIG. 5) also is in the test circuit for the nozzle 29 (see FIG. 6) of the spray gun 22 through having another conductor extending therefrom in addition to a conductor 90 (see FIG. 5).

In the test mode, a normally open reed switch 91 is closed by the programmable controller. Each of the test circuits for the nozzle 29 (see FIG. 6) of the spray gun 22 and the nozzle 30 of the spray gun 23 has a normally open reed switch corresponding to the normally open reed switch 91 (see FIG. 5) of the test circuit for the nozzle 28 (see FIG. 6) of the spray gun 21. These reed switches also are closed by the programmable controller when the reed switch 91 (see FIG. 5) is closed.

When a push button 92 is engaging contacts 93 and 94, a circuit is completed from the conductor 40 to the conductor 41 through the contacts 93 and 94, the reed switch 91, and the coil 70 of the solenoid valve 36. As a result of the coil 70 being energized, the solenoid valve 36 is closed to prevent spraying of material from the nozzle 28 (see FIG. 6) of the spray gun 21.

Since the push button 92 (see FIG. 5) bridges contacts similar to the contacts 93 and 94 in the test circuit for each of the nozzle 29 (see FIG. 6) of the spray gun 22 and the nozzle 30 of the spray gun 23, the single push button 92 (see FIG. 5) opens and closes all of the contacts with which it cooperates in each of the three test circuits at the same time. The opening of the contacts 93 (see FIG. 5) and 94 by the push button 92 causes interruption of current flow through only the coil 70 of the solenoid valve 36 because the switch portion 84 is bridging a third pair of contacts, which are similar to the first pair of contacts 85 and 86 and the second pair of contacts 87 and 88, in each of the test circuits for the nozzle 29 (see FIG. 6) of the spray gun 22 and the nozzle 30 of the spray gun 23.

Therefore, when the push button 92 (see FIG. 5) is moved away from the contacts 93 and 94, only the coil 70 of the solenoid valve 36 is deenergized. Thus, only the solenoid valve 36 is open so that only the nozzle 28 (see FIG. 6) of the spray gun 21 can supply material for test purposes.

When the nozzle 29 (see FIG. 6) of the spray gun 22 is to be tested, the switch portion 84 (see FIG. 5) is moved to its second position to engage the contacts 85 and 86. Thus, when the push button 92 (see FIG. 5) is moved away from the contacts 93 and 94, the coil 70 of the solenoid valve 36 remains energized through the contacts 85 and 86 being closed by the switch portion 84. The test circuit for the nozzle 30 (see FIG. 6) of the spray gun 23 also has the contacts 85 (see FIG. 5) and 86 therein so that the solenoid valve 38 (see FIG. 6) also remains closed. Accordingly, only the nozzle 29 of the spray gun 22 can apply material for test purposes with the switch portion 84 (see FIG. 5) in its second position.

When the nozzle 30 of the spray gun 23 is to be tested, the switch portion 84 (see FIG. 5) is moved to its third position to bridge the contacts 87 and 88. Thus, when the push button 92 is moved away from the contacts 93 and 94, the coil 70 of the solenoid valve 36 remains energized through the contacts 87 and 88 being closed by the switch portion 84. The test circuit for the nozzle 29 (see FIG. 6) of the spray gun 22 also has the contacts 87 (see FIG. 5) and 88 therein so that the solenoid valve 37 (see FIG. 6) also remains closed. Accordingly, only the nozzle 30 of the spray gun 23 can apply material for test purposes with the switch portion 84 (see FIG. 5) in its third position.

In its fourth position, the switch portion 84 (see FIG. 5) bridges a pair of contacts (not shown) to cause the programmable controller to deenergize the solenoid valve 35 (see FIG. 6). Thus, even though depressing of the push button 92 (see FIG. 5) would cause each of the three solenoid valves 36–38 (see FIG. 6) to be opened, the solenoid valve 35 is closed so that none of the nozzles 28–30 can spray any material even when the push button 92 (see FIG. 5) is moved to its open position because compressed air cannot be supplied to the nozzles 28–30 from the compressor 31.

When the switch portion 84 is in any of its other three positions in which one of the nozzles 28–30 (see FIG. 6) can be tested, the programmable controller energizes the solenoid valve 35 to keep it open. This insures that the nozzle being tested can spray material when the push button 92 (see FIG. 5) is moved to its open position.

While the present invention has been described as applying material to the sheet 10 (see FIG. 1) of metal, it should be understood that the material can be applied to any moving part. Thus, any other suitable sensors besides the proximity switches 42–47 (see FIG. 3) may be employed. For example, photoelectric sensors could be utilized where the sheet 10 is not metal.

While the proximity switches 42–47 have been shown and described as utilized for sensing both the leading edge 71 (see FIG. 1) and the trailing edge 73 of the sheet 10 of metal along with the presence of the notches 19 and 20, it should be understood that, if desired, the leading edge 71 and the trailing edge 73 of the sheet 10 of metal may be sensed by different sensors than those sensing the presence of the notches 19 and 20. Thus, additional sensors could be employed to sense the leading edge 71 and the trailing edge 73 of the sheet 10 of metal. For each pair of the proximity switches 42–47 (see FIG. 3) such as the proximity switches 42 and 43, for example, this would require inactivation of the proximity switches 42 and 43 when the leading edge 71 passes them and then activating them after the leading edge 71 of the sheet 10 of metal has passed the proximity switch 43. Then, the additional sensors would be rendered ineffective until a counter, for example, has counted the sensing of the notches 19 and 20 by the proximity switches 42 and 43. Next, the proximity switches 42 and 43 would be rendered ineffective and the additional sensors rendered effective to sense the presence of the trailing edge 73 of the sheet 10 of metal.

It also should be understood that notches or other interruptions in the moving part are not a requisite for satisfactory operation. For example, the moving part could use dark and light areas printed on paper attached to the moving part to indicate when to start and stop the application of material between the leading and trailing edges of the moving part.

An advantage of this invention is that spraying of a moving part in undesired areas is avoided. Another advantage of this invention is that an outer case of a refrigerator cabinet in its unfolded configuration is not sprayed in areas in which it is to later be folded.

For purposes of exemplification, a particular embodiment of the invention has been shown and described according to the best present understanding thereof. However, it will be apparent that changes and modifications in the arrangement and construction of the parts thereof may be resorted to without departing from the spirit and scope of the invention.

We claim:

1. A method for applying a material to selected areas of a moving part during movement past material applying means including:

initially starting application of material to the moving part after its leading edge passes the material applying means by sensing when the leading edge of the moving part is a predetermined distance past the material applying means;

stopping application of material to the moving part prior to at least one predetermined portion of the moving part reaching the material applying means;

starting application of material to the moving part after the one predetermined portion has passed the material applying means;

and finally stopping application of material to the moving part prior to the trailing edge of the moving part reaching the material applying means.

2. The method according to claim 1 in which the initial starting of application of material to the moving part is when the leading edge of the moving part is the predetermined distance past the material applying means.

3. The method according to claim 2 in which final stopping of application of material to the moving part is when the trailing edge of the moving part is a predetermined distance prior to the material applying means.

4. The method according to claim 3 including sensing when the trailing edge of the moving part is the predetermined distance prior to the material applying means.

5. The method according to claim 4 including:

sensing when the one predetermined portion of the moving part passed a first predetermined position prior to the material applying means to stop application of material from the material applying means;

and sensing when the one predetermined portion of the moving part passes a second predetermined position beyond the material applying means to start application of material from the material applying means.

6. The method according to claim 5 including:

sensing when the trailing edge of the moving part is the predetermined distance prior to the material applying means by sensing its presence at the first predetermined position prior to the material applying means at which the one predetermined portion of the moving part is sensed;

and sensing when the leading edge of the moving part is the predetermined distance past the material applying means by sensing its presence at the second predetermined position beyond the material applying means at which the one predetermined portion of the moving part is sensed.

7. The method according to claim 3 including:

stopping application of material to the moving part prior to each of a plurality of spaced predetermined portions of the moving part reaching the material applying means;

and starting application of material to the moving part after each of the plurality of spaced predetermined portions has passed the material applying means.

8. The method according to claim 7 including:

sensing when each of the spaced predetermined portions of the moving part passes a first predetermined position prior to the material applying means to stop application of material from the material applying means;

and sensing when each of the spaced predetermined portions of the moving part passes a second predetermined position beyond the material applying means to start application of material from the material applying means.

9. The method according to claim 8 including:

sensing when the trailing edge of the moving part is the predetermined distance prior to the material applying means by sensing its presence at the first predetermined position prior to the material applying means at which each of the spaced predetermined portions of the moving part is sensed;

and sensing when the leading edge of the moving part is the predetermined distance past the material applying means by sensing its presence at the second predetermined position beyond the material applying means at which each of the spaced predetermined portions of the moving part is sensed.

10. The method according to claim 1 including:

stopping application of material to the moving part prior to each of a plurality of spaced predetermined portions of the moving part reaching the material applying means;

and starting application of material to the moving part after each of the plurality of spaced predetermined portions has passed the material applying means.

11. The method according to claim 10 including:

sensing when each of the spaced predetermined portions of the moving part passes a first predetermined position prior to the material applying means to stop application of material from the material applying means;

and sensing when each of the spaced predetermined portions of the moving part passes a second predetermined position beyond the material applying means to start application of material from the material applying means.

12. The method according to claim 1 including:

sensing when the one predetermined portion of the moving part passes a first predetermined position prior to the material applying means to stop application of material from the material applying means;

and sensing when the one predetermined portion of the moving part passes a second predetermined position beyond the material applying means to start application of material from the material applying means.

13. The method according to claim 12 including:

stopping application of material to the moving part prior to each of a plurality of spaced predetermined portions of the moving part reaching the material applying means;

and starting application of material to the moving part after each of the plurality of spaced predetermined portions has passed the material applying means.

14. An apparatus for applying material to selected areas of a moving part including:

material applying means positioned at a selected position along the path of the moving part;

first determining means for determining when the moving part has its leading edge advance past said material applying means to cause initial activation of said material applying means to apply material to the moving part;

second determining means for determining when the moving part has its trailing edge a predetermined distance prior to said material applying means to cause final inactivation of said material applying means to stop application of material to the moving part;

said second determining means including means to determine when at least one predetermined portion of the moving part is a predetermined distance prior to said material applying means to inactivate said material applying means;

and said first determining means including means to determine when the one predetermined portion of the moving part is a predetermined distance past said material applying means to activate said material applying means.

15. The apparatus according to claim 14 in which:

said first determining means includes first sensing means disposed at a first selected position a predetermined distance past said material applying means for sensing the leading edge of the moving part and the one predetermined portion of the moving part;

and said second determining means includes second sensing means disposed at a second selected position a predetermined distance prior to said material applying means for sensing the trailing edge of the moving part and the one predetermined portion of the moving part.

16. The apparatus according to claim 15 including control means for controlling the activation and inactivation of said material applying means in response to each of said first sensing means and said second sensing means.

17. The method according to claim 1 including sensing when the trailing edge of the moving part is a predetermined distance prior to the material applying means to cause final stopping of application of material to the moving part when the trailing edge of the moving part is the predetermined distance prior to the material applying means.

18. An apparatus for applying material to selected areas of a moving part including:

material applying means positioned at a selected position along the path of the moving part;

first determining means for determining when the moving part has its leading edge advance past said material applying means to cause initial activation of said material applying means to apply material to said moving part;

second determining means for determining when at least one predetermined portion of the moving part is a predetermined distance prior to said material applying means to cause inactivation of said material applying means;

said first determining means also determining when the one predetermined portion of the moving part is a predetermined distance past said material applying means to cause activation of said material applying means;

and said second determining means also determining when the moving part has its trailing edge a predetermined distance prior to said material applying means to cause final inactivation of said material applying means to stop application of material to the moving part.

19. The apparatus according to claim 18 in which:

said first determining means includes first sensing means disposed at a first selected position a predetermined distance past said material applying means for sensing the leading edge of the moving part and the one predetermined portion of the moving part;

and said second determining means includes second sensing means disposed at a second selected position a predetermined distance prior to said material applying means for sensing the trailing edge of the moving part and the one predetermined portion of the moving part.

20. The apparatus accoridng to claim 19 including control means for controlling the activation and inactivation of said material applying means in response to each of said first sensing means and said second sensing means.

* * * * *